US007703550B2

(12) United States Patent
Nevlud et al.

(10) Patent No.: US 7,703,550 B2
(45) Date of Patent: Apr. 27, 2010

(54) DOWN HOLE MOTOR WITH LOCKING MECHANISM

(75) Inventors: Kenneth M. Nevlud, The Woodlands, TX (US); Timothy P. Beaton, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 564 days.

(21) Appl. No.: 11/049,926

(22) Filed: Feb. 3, 2005

(65) Prior Publication Data

US 2005/0173155 A1 Aug. 11, 2005

Related U.S. Application Data

(60) Provisional application No. 60/542,452, filed on Feb. 6, 2004.

(51) Int. Cl.
*E21B 4/00* (2006.01)

(52) U.S. Cl. ..... 175/106; 175/92

(58) Field of Classification Search ..... 175/92–107, 175/321; 464/170; 192/45
See application file for complete search history.

(56) References Cited

U.S. PATENT DOCUMENTS

| | | | | |
|---|---|---|---|---|
| 438,666 | A | 10/1890 | Weston | |
| 2,167,019 | A * | 7/1939 | Yost | 175/107 |
| 3,101,925 | A * | 8/1963 | Dziallas et. al. | 175/107 |
| 3,667,556 | A * | 6/1972 | Henderson | 175/107 |
| 3,871,193 | A * | 3/1975 | Young | 175/321 |
| 3,898,815 | A * | 8/1975 | Young | 175/321 |
| 4,187,918 | A | 2/1980 | Clark | |
| 4,295,535 | A * | 10/1981 | Crase et al. | 175/107 |
| 4,388,973 | A * | 6/1983 | Winkelmann et al. | 175/107 |
| 4,632,193 | A * | 12/1986 | Geczy | 175/107 |
| 5,871,071 | A | 2/1999 | Sink | |
| 6,129,190 | A | 10/2000 | Reed et al. | |
| 6,220,414 | B1 | 4/2001 | Nagaya et al. | |
| 6,481,551 | B1 | 11/2002 | Ruth | |
| RE38,498 | E | 4/2004 | Ruth et al. | |
| 6,796,414 | B2 | 9/2004 | Hu et al. | |
| 2009/0020337 | A1 * | 1/2009 | Swietlik et al. | 175/101 |

FOREIGN PATENT DOCUMENTS

| | | |
|---|---|---|
| DE | 2917331 A1 | 11/1980 |
| GB | 2 047 778 | 12/1980 |

(Continued)

OTHER PUBLICATIONS

Combined Search and Examination Report for Patent Application No. GB0502623.4 dated Feb. 6, 2005 (5 pages).

(Continued)

*Primary Examiner*—Richard E Chilcot, Jr.
*Assistant Examiner*—Matthew J Smith
(74) *Attorney, Agent, or Firm*—Osha • Liang LLP

(57) ABSTRACT

A down hole motor assembly with a locking mechanism, and methods for operating said down hole motor assembly. The down hole motor has a housing operatively connectable at an upper end to a drill string. A shaft is disposed within the housing and operatively connected to a motor portion of the down hole motor. A locking mechanism is configured to selectively transmit torque from the housing to the shaft when engaged.

18 Claims, 2 Drawing Sheets

FOREIGN PATENT DOCUMENTS

| | | |
|---|---|---|
| GB | 2 055 927 | 3/1981 |
| GB | 2 378 197 | 2/2003 |
| WO | WO-01/04451 A1 | 1/2001 |

OTHER PUBLICATIONS

Office Action in Canadian Patent Application No. 2,496,098, dated Jul. 8, 2009 (3 pages).

Official Action (English & German translation) issued in German patent application No. 10 2005 005 289.4-24 dated Jul. 24, 2006 (4 pages).

Office Action in German Patent Application No. 10 2005 005 289.4-24, dated Sep. 18, 2009, with English translation (5 pages).

* cited by examiner

DOWN HOLE MOTOR WITH LOCKING MECHANISM

CROSS-REFERENCE TO RELATED APPLICATIONS

This application claims the priority, pursuant to 35 U.S.C. §119(e), of U.S. Provisional Application No. 60/542,452, entitled, "Downhole Motor with Locking Clutch," filed on Feb. 6, 2004. That application is incorporated by reference in its entirety.

BACKGROUND OF INVENTION

In the drilling of well bores in the oil and gas industry it is common practice to use down hole motors to drive a drill bit through a formation. Down hole motors used for this purpose are typically driven by drilling fluids pumped from surface equipment through the drill string. This type of motor is commonly referred to as a mud motor. In use, the drilling fluid is forced through the mud motor, which extracts energy from the flow to provide rotational force to a drill bit located below the mud motors. There are two primary types of mud motors: positive displacement motors ("PDM") and turbodrills. A less common down hole motor may be driven by electricity. As used herein, a "down hole motor" refers generally to any motor used in a well bore for drilling through a formation. As used herein, a "motor portion" refers to the portion of the down hole motor that generates torque.

A PDM is based on the Moineau principle. Drilling fluid is forced through a stator. An eccentric rotor is located inside the stator. Drilling fluid circulating through the stator imparts a rotational force on the rotor causing it to rotate a shaft. This rotational force is transmitted to a drill bit located below the PDM.

A turbine uses one or more turbine stages to provide rotational force to a drill bit. Each stage consists of a non-moving stator and a rotor mechanically linked to a shaft. The stator directs the flow prior to entrance into the rotor in order to provide more rotational force. Drilling fluid passing between blades on the rotor causes the rotor to rotate the shaft and the drill bit located below the turbine.

During drilling, the drill bit may get stuck in the formation. If a bit-sticking issue develops and the drill bit cannot be freed, the entire bottom hole drilling assembly may be lost in the well bore. If this occurs, in addition to the value of the lost tools, a sidetracking trip to deviate around the stuck assembly is often necessary. This is an extremely expensive consequence.

In the event that a drill bit becomes stuck, it is a common practice to apply a sufficiently large torque generated at the surface through the entire drill string to free the drill bit. This would not be effective if down hole motors are used because the configuration of down hole motors prevents torque from being transmitted from the surface to the drill bit. Typically, the housing of a down hole motor is connected to the drill string at the upper end. The shaft contained within the housing is not rotationally linked to the housing in a manner that allows torque transmission from the drill string to the shaft (i.e. rotate freely relative to each other), and it is the lower end of the shaft that is connected to the drill bit (some tools may be in the drill string between the shaft and the drill bit). As a result, the only torque that can be transmitted to the stuck drill bit is the torque that the down hole motor is able to produce. What torque can be transmitted by the down hole motor is very little relative to what can be transmitted from a surface rotary tool, and is typically insufficient to free the stuck drill bit.

In the prior art, one method known for transmitting torque from the motor housing to the internal shaft is through the use of locking balls. The locking balls are metal spheres that are dropped from the surface into the down hole motor where they are lodged in specific cavities between the housing and shaft. These cavities are shaped such that when the housing is rotated, the locking balls pinch against the shaft. This locks up the housing with the shaft. This allows for a connection in the work string above the down hole motor to be backed off, leaving the down hole motor, the drill bit, and other components in the well bore. The components left in the well bore must then be side tracked around to continue the drilling of the well bore.

There are several limitations to this prior art method. Even if successful in their function, the locking balls still require leaving components in a well bore, which must then be fished out or side tracked around. Both of which cost a substantial amount of time and money. Further, this approach is sometimes unable to sufficiently lock up the housing to the shaft, which can prevent backing off a connection above the down hole motor. This would result in more expensive, difficult, and time consuming fishing operations. A further limitation to the use of locking balls is that they may not always be deployable based on the components in the drill string. For example, many designs of measurement while drilling ("MWD") tools, which are deployed above the down hole motors in the drill string, do not allow for locking balls to pass through them.

What is still needed are down hole motors and methods for preventing a drill bit from becoming stuck and for freeing a stuck drill bit. Further, it is desirable to be able to apply torque through the housing to the shaft of the down hole motor as needed without the use of objects dropped into the well bore such as locking balls.

SUMMARY OF INVENTION

In one aspect, the present invention relates to a down hole motor having a housing operatively connectable at an upper end to a drill string. A shaft is disposed within the housing and operatively connected to a motor portion of the down hole motor. A locking mechanism is configured to selectively transmit torque from the housing to the shaft when engaged.

In another aspect, the present invention relates to a method of operating a down hole motor. The method includes rotating a shaft disposed within a housing of the down hole motor, the shaft being operatively connected to a motor portion of the down hole motor. Torque is applied from a surface rotary tool to a drill string attached to an upper end of the housing. A locking mechanism disposed in the down hole motor engages such that torque is transmitted from the housing to the shaft. The engaging occurs when a rotational speed of the housing is greater than a rotational speed of the shaft.

In another aspect, the present invention relates to a method of operating a down hole motor disposed in a well bore. The method includes rotating a shaft disposed within a housing of the down hole motor, the shaft being operatively connected to a motor portion of the down hole motor, and engaging a locking mechanism disposed in the down hole motor such that torque is transmitted from the housing to the shaft. Torque is applied from a surface rotary tool to a drill string attached to an upper end of the housing. The locking mechanism is disengaged without having to trip the down hole motor out of the well bore to disengage the locking mechanism.

In another aspect, the present invention relates to a method for freeing a drill bit. The drill bit is operatively connected to a shaft that is operatively connected to a motor portion of a down hole motor. The down hole motor includes a housing and the shaft. The housing is operatively connected at an upper end to a drill string. The method includes applying torque from a surface rotary tool to the drill string and engaging a locking mechanism disposed in the down hole motor such that torque is transmitted from the housing to the shaft to free the drill bit Other aspects and advantages of the invention will be apparent from the following description and the appended claims.

DETAILED DESCRIPTION

The present invention relates to a down hole motor assembly with a locking mechanism, and methods for operating said down hole motor assembly.

In particular, various embodiments of the present invention provide a number of different constructions and methods of operation. It is to be fully recognized that the different teachings of the embodiments discussed below may be employed separately or in any suitable combination to produce desired results. Reference to up or down will be made for purposes of description with "up" or "upper" meaning toward the surface of the well and "down" or "lower" meaning toward the bottom of the primary well bore or lateral borehole.

Figure 1A:
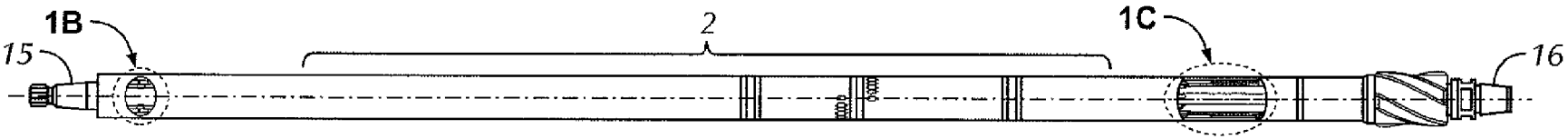
FIG. 1A shows a down hole motor in accordance with one embodiment of the present invention.
Figure 1C:
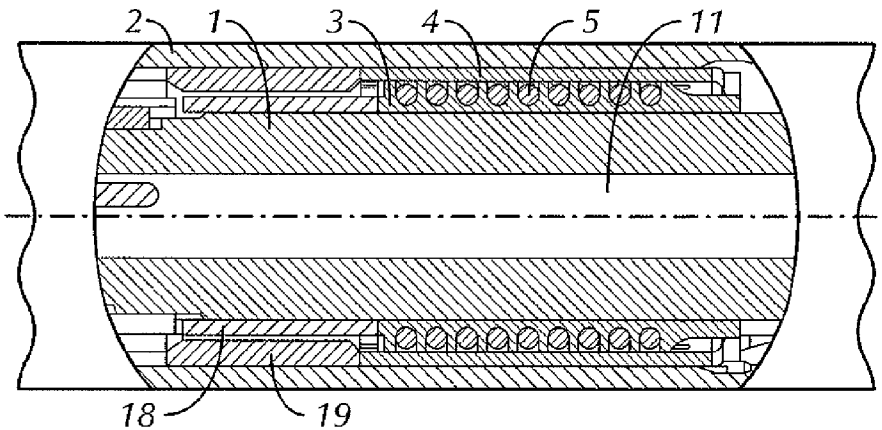
FIGS. 1B and 1C show detailed views of portions of the down hole motor shown in FIG. 1A.
Figure 1B:
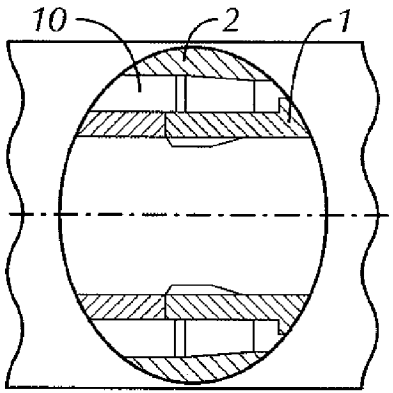

In FIGS. 1A, 1B, and 1C, a down hole motor in accordance with an embodiment of the present invention is shown. In FIG. 1A, the down hole motor is a turbine; however, those of ordinary skill in the art will appreciate that a locking mechanism may also be attached to a PDM or an electric motor, the housing of which typically has the same characteristic in that it is not rotationally linked to a shaft. FIG. 1A is representative of a turbine in that it has an upper connection 15 and a lower connection 16 that are connectable to a work string (not shown). The housing 2 contains several working components of the turbine (e.g. thrust bearings), which those of ordinary skill in the art will be able to design without further disclosure. The upper connection 15 is rotationally fixed relative to the housing 2, while the lower connection 16 is rotationally fixed relative to the shaft 1 (visible in FIGS. 1B and 1C). The turbine is operated by pumping drilling fluid through the drill string into the annular space 10. The flow of the drilling fluid is directed through the turbine stages (located in a motor portion, not shown, above the upper connection 15). After being used to provide rotational force in the turbine stages, the drilling fluid exits the turbine through the annular space 11, which continues through the lower connection 16. Those having ordinary skill in the art will be able to design suitable motor portions for providing rotational force.

In order to selectively transmit torque from the housing 2 to the shaft 1, embodiments of the present invention use a locking mechanism to selectively provide a rotational link between the housing 2 and the shaft 1. In one or more embodiments, the locking mechanism may be a locking clutch, which is commonly referred to as a one-way clutch. Transmitting torque from the housing 2 to the shaft 1 may be desired when a down hole motor stalls during drilling or a drill bit becomes stuck. FIG. 1C shows a detailed view of a locking mechanism in accordance with one embodiment of the present invention. The locking mechanism shown in FIG. 1C resembles one way clutches known in the art for other applications, and has been configured to work with a down hole motor. In this embodiment, the locking mechanism is disposed at the lower end of the shaft 1 (position on the turbine is shown in FIG. 1A). One advantage of locating the locking mechanism on the lower end of the shaft 1 is that the shaft 1 is typically the strongest at its lower end. The relative size of the upper end of the shaft 1 is shown in FIG. 1B. In some embodiments, the lower end of the shaft 1 may be able to withstand three to four times the amount of torque than the upper end of the shaft 1. Disposing the locking mechanism at the lower end also prevents large amounts torque from being transmitted through any other weak portions of the shaft 1 that may exist. However, one of ordinary skill in the art will appreciate that the locking mechanism can also be disposed at other locations (including the upper end) of the down hole motor without departing from the scope of the invention. Those having ordinary skill in the art will appreciate that other locking mechanisms known in the art may be configured for use in a down hole motor, as disclosed herein.

FIG. 1C shows a locking mechanism that may be used in accordance with one embodiment of the present invention. The locking mechanism shown in FIG. 1C is designed to engage based on relative rotation between the shaft 1 and the housing 2. When the down hole motor is operating correctly during drilling, the shaft 1 will be turning at a higher speed than the housing 2, which may be stationary. Should the drill bit become stuck, the shaft 1 would cease turning and, if torque is applied to the drill string from the surface, the housing 2 would start to turn relative to the shaft 1, which would cause the locking mechanism to engage and apply torque to the shaft 1. If the drill bit is freed and rotation of the shaft 1 is able to begin again, the locking mechanism will disengage allowing normal operation of the down hole motor to continue. By providing for such a method of allowing the locking mechanism to disengage, there will be no need to make the extra trip to pull the tool out of the hole to repair or reset the motor assembly, as is required when locking balls are used in prior art methods.

Figure 2A:
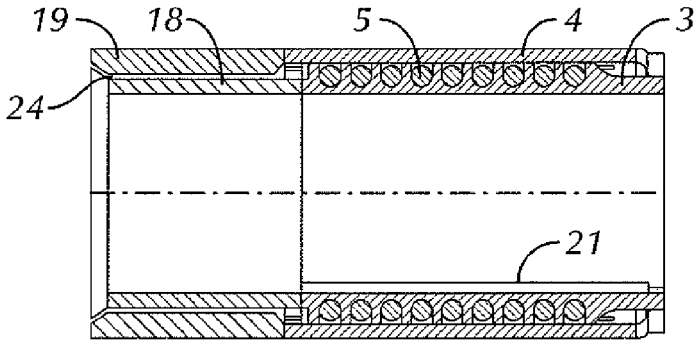
FIG. 2A shows a cross section of a locking mechanism in accordance with one embodiment of the present invention.
Figure 2C:
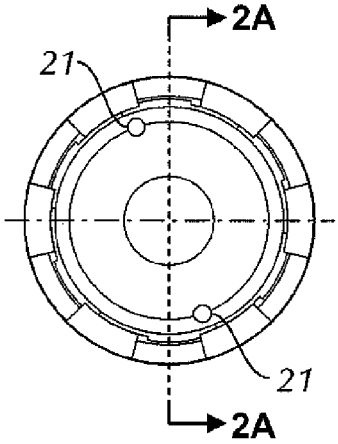
FIG. 2C shows an end view of the locking mechanism shown in FIG. 2A.
Figure 2B:
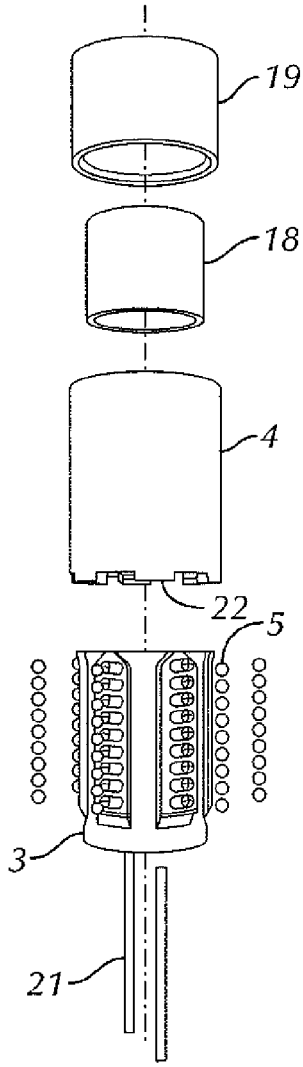
FIG. 2B shows an exploded view of the locking mechanism shown in FIG. 2A.

FIGS. 2A, 2B, and 2C show views of a locking mechanism that is not installed in a down hole motor. As discussed above, the locking mechanism is intended to selectively transmit torque from the housing 2 to the shaft 1. The locking mechanism shown in FIGS. 2A, 2B, and 2C is designed to be sensitive to relative rotations between the housing and the shaft as described above with respect to FIG. 1C. This locking mechanism includes an inner drive 3 and an outer drive 4. The inner drive 3 may rotationally linked to the shaft 1 using, for example, keys 21. The outer drive 4 may be rotationally linked to the housing 2 using, for example, a castellation 22 on the lower end of the outer drive 4. Ball bearings 5 are installed in tapered slots formed in the inner drive 3. The tapered slots are tapered such that, when the shaft 1 is turning relative to the housing 2, the ball bearings 5 do not protrude from the tapered slots (e.g., at location A shown in FIG. 3). When the shaft 1 is not turning and torque is applied to the housing 2 through the drill string, the ball bearings 5 move towards a shallower location (location B in FIG. 3) in the tapered slots such that they wedge between the inner drive 3 and the outer drive 4. This causes the inner drive 3 to turn with the housing 2, and in turn apply torque to the shaft 1 through the keys 21. If the drill bit is successfully freed, drilling fluid may be pumped through the down hole motor to begin rotating the drill bit using the shaft 1. When this occurs, the ball bearings 5 will move toward the deeper location (location A in FIG. 3) in the tapered slot and little or no torque will be transmitted between the housing 2 and the shaft 1.

Continuing with FIGS. 2A and 2B, a locking mechanism in accordance with one embodiment of the invention may further include a restriction bush 18 and a restriction sleeve 19. When drilling fluid is pumped through the down hole motor, most of the drilling fluid exits the down hole motor through the annular space 11 in the shaft 1 (see FIG. 1C). Typically, bearings (not shown) are disposed proximate the end of the shaft 1. To help cool those bearings, a clearance 24 may exist between the restriction bush 18 and the restriction sleeve 19. Flow through the clearance 24 helps to cool and lubricate bearings and other components disposed in the down hole motor in and below the locking mechanism.

Although the above example shows the tapered slots formed on the inner drive 3, which is connected to the shaft 1, one of ordinary skill in the art will appreciate that the tapered slots may instead be formed on the outer drive 4, which is connected to the housing 2. Further, forming the tapered slots directly on the housing 2 or shaft 1 is equivalent to having the separate components, inner drive 3 and outer drive 4. However, separate components provide for easier assembly and replacement of the locking mechanism.

Other locking mechanisms used in other fields may be used in place of the locking mechanism disclosed herein. For example, one-way clutches used in the automotive industry as transmissions may be configured to be used with down hole motors. Examples of potentially suitable one-way clutches include U.S. Pat. No. 5,871,071 ("Sink") and U.S. Pat. No. 6,481,551 ("Ruth"). Those patents are incorporated herein by reference in their entireties. Ruth and Sink use disks that are able to rotate relative to each other in one direction. A first disk contains a series of notches that are angled on one side and parallel to the central axis on the other side. The second disk contains "pawls" that are biased towards the first disk. In the free running direction, the pawls do not grab as they slide against the angled side of the notches. In the engaged direction, the pawl locks against the side that is parallel to the central axis, which allows for torque to be transmitted between the disks. Other similarly suitable locking mechanisms used in ratchet wrenches may also be configured for use in down hole motors.

Figure 3:
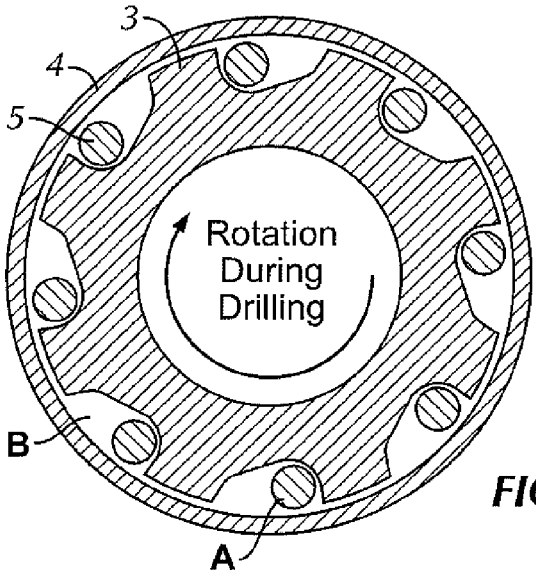
FIG. 3 shows a cross section of a locking mechanism in accordance with one embodiment of the present invention.

Other examples of potentially suitable locking mechanisms include those using rollers or "sprags" between an inner drive and an outer drive, arranged similarly to the locking mechanism shown in FIGS. 1C, 2A, and 3. One locking mechanism using rollers is disclosed in U.S. Pat. No. 6,796,414 ("Hu"). That patent is incorporated herein by reference in its entirety. The locking mechanism used by Hu is referred to as a one-way clutch and uses rollers disposed in slots similar to those used for the ball bearings disclosed above. An example of a locking mechanism using sprags is disclosed in U.S. Pat. No. 6,220,414 ("Nagaya"). That patent is incorporated herein by reference in its entirety. The sprags disclosed by Nagaya work similarly to ball bearings and rollers disposed in slots, in that the sprags wedge to allow torque transmission and slip in the other. This behavior is due to a curved shape that allows the sprags to pivot differently in the two rotational directions.

Drilling while using embodiments of the present invention helps to both prevent having a drill bit become stuck in a well bore, and, should a drill bit become stuck, embodiments of the present invention may be used to free the drill bit. Typically, while drilling using a down hole motor, the drill string is rotated at a lower RPM than the shaft of the down hole motor. During that time, a locking mechanism in accordance with embodiments of the present invention would not be engaged, however, during drilling, a down hole motor may begin to stall if too much weight is placed on the drill bit or other drilling problems occur. When a down hole motor begins to stall, the rotational speed of the shaft is reduced. In the prior art, there would be significant risk of the drill bit becoming stuck as the rotational speed of the shaft is reduced. Using a locking mechanism as disclosed herein allows for the down hole motor to recover from stalling prior to getting the drill bit stuck. For example, if the drill string is being rotated by a surface rotary tool at 100 RPM while the down hole motor is rotating at 200 RPM, a locking mechanism would engage when the down hole motor stalls to a rotational speed below 100 RPM. At that point, torque from the surface rotary tool would be transmitted to the shaft to prevent a stall. The down hole motor could then recover and return to the higher rotational speed, which would automatically disengage the locking mechanism.

In some drilling situations, the drill string is not rotated during certain intervals while drilling with a down hole motor. This is common during directional changes using steerable down hole motors, and commonly referred to as "sliding." In such a situation, the locking mechanism may not prevent stalling if the drill string is not rotated prior to the drill bit becoming completely stuck. After engaging the locking mechanism, however, rotating the drill string after the drill bit becomes stuck will apply torque to the drill bit via the locking mechanism, and may in many instances be able to free the drill bit. In one embodiment, once the drill bit is free, the drilling operation may begin again after disengaging the locking mechanism without returning the down hole motor to the surface. In another embodiment, the down hole motor and drill bit may be brought to the surface without disengaging the locking mechanism.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A down hole motor comprising:

a housing operatively connectable at an upper end to a drill string;

a shaft disposed within the housing and operatively connected to a motor portion of the down hole motor; and a locking mechanism comprising:

a discreet elongated member configured to rotationally link the shaft to the locking mechanism; and a plurality of locking members configured to selectively transmit torque from the housing to the shaft when engaged, wherein the locking mechanism selectively transmits torque from the housing to the shaft when a rotational speed of the shaft is less than a rotational speed of the housing.

2. The down hole motor of claim 1, wherein the down hole motor is one selected from the group consisting of a turbine, a positive displacement motor, and an electric motor.

3. The down hole motor of claim 1, wherein the locking mechanism is disposed on a lower end of the shaft.

4. The down hole motor of claim 1, wherein the locking mechanism is configured to be disengaged.

5. The down hole motor of claim 1, wherein a third locking member of the plurality of locking members is disposed in a circumferential direction about the axis of the shaft with respect to the first locking member of the plurality of locking members.

6. The down hole motor of claim 1, wherein a first locking member of the plurality of locking members is disposed in a longitudinal direction along an axis of the shaft with respect to a second locking member of the plurality of locking members.

7. The down hole motor of claim 6, wherein the first locking member and the second locking member maintain a substantially constant longitudinal distance between each other.

8. A method of operating a down hole motor disposed in a well bore, the method comprising:

rotating a shaft disposed within a housing of the down hole motor, the shaft being operatively connected to a motor portion of the down hole motor;

applying torque from a surface rotary tool to a drill string attached to an upper end of the housing; and engaging a locking mechanism comprising:

a discreet elongated member configured to rotationally link the shaft to the locking mechanism; and a plurality of locking members disposed in the down hole motor and configured to selectively transmit the torque from the housing to the shaft, wherein a first locking member of the plurality of locking members is disposed in a longitudinal direction along an axis of the shaft with respect to a second locking member of the plurality of locking members, and wherein the engaging occurs when a rotational speed of the housing is greater than a rotational speed of the shaft.

9. The method of claim 8, wherein the down hole motor is one selected from the group consisting of a turbine, a positive displacement motor, and an electric motor.

10. The method of claim 8, further comprising:

disengaging the locking mechanism by rotating the shaft using the motor portion of the down hole motor.

11. The method of claim 8, further comprising:

stopping the rotation of the shaft due to a drill bit attached to the drill string becoming stuck; and returning to drilling with the down hole motor after the drill bit is free, wherein the down hole motor is not tripped out of the well bore before returning to drilling.

12. A method of operating a down hole motor disposed in a well bore, the method comprising:

rotating a shaft disposed within a housing of the down hole motor, the shaft being operatively connected to a motor portion of the down hole motor;

engaging a locking mechanism comprising:

a discreet elongated member configured to rotationally link the shaft to the locking mechanism; and a plurality of locking members disposed in the down hole motor such that torque is transmitted from the housing to the shaft, wherein a first locking member of the plurality of locking members is disposed in a longitudinal direction along an axis of the shaft with respect to a second locking member of the plurality of locking members;

applying torque from a surface rotary tool to a drill string attached to an upper end of the housing; and disengaging the locking mechanism, wherein the down hole motor is not tripped out of the well bore to disengage the locking mechanism;

wherein the disengaging occurs when a rotational speed of the shaft is greater than a rotational speed of the housing.

13. The method of claim 12, wherein the down hole motor is one selected from the group consisting of a turbine, a positive displacement motor, and an electric motor.

14. The method of claim 12, wherein the engaging occurs when a rotational speed of the housing is greater than a rotational speed of the shaft.

15. The method of claim 12, further comprising:

stopping the rotation of the shaft due to a drill bit attached to the drill string becoming stuck.

16. A method for freeing a drill bit operatively connected to a shaft that is operatively connected to a motor portion of a down hole motor, the down hole motor comprising a housing and the shaft, the housing being operatively connected at an upper end to a drill string, the method comprising:

applying torque from a surface rotary tool to the drill string;

engaging a locking mechanism comprising:

a discreet elongated member configured to rotationally link the shaft to the locking mechanism; and a plurality of locking members and disposed in the down hole motor such that torque is transmitted from the housing to the shaft to free the drill bit, wherein a first locking member of the plurality of locking members is disposed in a longitudinal direction along an axis of the shaft with respect to a second locking member of the plurality of locking members such that the first locking member and the second locking member maintain a substantially constant longitudinal distance between each other;

disengaging the locking mechanism, wherein the disengaging occurs when a rotational speed of the shaft is greater than a rotational speed of the housing; and returning to drilling with the down hole motor after the drill bit is free, wherein the down hole motor is not tripped out of the well bore before returning to drilling.

17. The method of claim 16, further comprising:

retrieving the drill bit and the down hole motor from the well bore after freeing the drill bit.

18. The method of claim 16, wherein the down hole motor is one selected from the group consisting of a turbine, a positive displacement motor, and an electric motor.

* * * * *